United States Patent [19]

Fukai et al.

[11] Patent Number: 4,693,674

[45] Date of Patent: Sep. 15, 1987

[54] CYLINDER HEAD FOR REFRIGERANT COMPRESSOR

[75] Inventors: Isamu Fukai, Fujioka; Katsumasa Azami, Isesaki, both of Japan

[73] Assignee: Sanden Corporation, Gunma, Japan

[21] Appl. No.: 832,876

[22] Filed: Feb. 26, 1986

[30] Foreign Application Priority Data

Feb. 26, 1985 [JP] Japan ..... 60-25399[U]

[51] Int. Cl.[4] ..... F04B 39/12

[52] U.S. Cl. ..... 417/269; 417/571

[58] Field of Search ..... 417/269, 270, 571, 564, 417/563

[56] References Cited

U.S. PATENT DOCUMENTS 4,544,332 10/1985 Shibuya ..... 417/269

FOREIGN PATENT DOCUMENTS 1214370 4/1960 France ..... 417/571

176371 10/1982 Japan ..... 417/269

*Primary Examiner*—Leonard E. Smith

*Attorney, Agent, or Firm*—Banner, Birch, McKie & Beckett

[57] ABSTRACT

A cylinder head for a piston type refrigerant compressor is disclosed. The cylinder head of the compressor is provided with an inner partition wall and an outer peripheral wall adapted to contact a gasket of the compressor such that the interior of cylinder head is divided into a suction chamber and a discharge chamber. The inner partition wall is made slightly longer than the outer wall such that upon mounting the cylinder head to the compressor the force pressing the inner partition wall against the gasket element is substantially equal to the force pressing the outer peripheral wall against the gasket element.

6 Claims, 3 Drawing Figures

CYLINDER HEAD FOR REFRIGERANT COMPRESSOR

TECHNICAL FIELD

This invention relates to a piston type refrigerant compressor, and more particularly, to a construction of a cylinder head for the compressor which provides improved sealing between a suction chamber and a discharge chamber formed within the cylinder head.

BACKGROUND OF THE INVENTION

In a conventional piston type refrigerating compressor, the compressor is provided with a cylinder block and a cylinder head wherein the cylinder head is mounted to the cylinder block through a valve plate and two gasket elements. The cylinder head is divided into two chambers, such as a suction chamber and a discharge chamber, by an outer peripheral wall portion and an inner partition wall portion. These wall portions are generally equal in length and they are generally parallel to one another and include end surfaces which are disposed in a common plane, the common plane being perpendicular to each wall portion. The end surface of each wall portion is mounted to the valve plate and the gasket element. Hence, a seal is created between the suction and discharge chambers as well as between the suction chamber and between the space external to the cylinder head.

In the above described construction of the compressor, the cylinder head is normally secured to the compressor housing, in contact with the gasket elements and the valve plate, by a plurality of bolts. The bolts are arranged about the perimeter of the cylinder head and extend through the outer wall portions thereof. Therefore, the force pressing the end surface of the outer wall portion to the gasket element is different than the force pressing the end surface of the partition wall portion to the gasket element. Hence, the seal created by the contact between the inner partition wall and the gasket element may not be as consistent as the seal created between the outer wall portion and the gasket element.

Also, the pressure in the suction chamber, which is formed on the outer peripheral portion of the cylinder head, is relatively lower than the pressure in the space external to the compressor. Therefore, a reliable seal must be created between the suction chamber and the space external to the compressor. Further, the pressure in the discharge chamber is higher than the pressure in the suction chamber and, hence, a reliable seal is also needed between these two chambers. However, as mentioned hereinabove, the seal created between the gasket element and the end surface of the partition wall portion may not be as consistent as the seal created between the outer wall portion and the gasket element. Hence, although the seal between the outer wall surface and the gasket element may be reliable, the seal between the inner partition wall portion and the gasket element may not. Thus, the compressed fluid in the discharge chamber may leak through to the suction chamber, resulting in reduced compression efficiency.

SUMMARY OF THE INVENTION

It is a primary object of this invention to provide an improved refrigerant compressor wherein a reliable seal is created between the suction chamber and the discharge chamber.

It is another object of this invention to provide a refrigerant compressor wherein the compression efficiency is improved with only a small modification to the compressor.

It is a further object of the present invention to provide a cylinder head adapted to be mounted to the cylinder block of a compressor such that a reliable seal is created between both the outer wall of the cylinder head and the cylinder block and between the inner wall of the cylinder head and the cylinder block.

In accordance with this invention, a piston type refrigerant compressor includes a cylinder block having a plurality of cylinders and a respective plurality of pistons, each piston being placed in one of the cylinders for reciprocal motion. A valve plate has a plurality of suction ports and discharge ports, each suction port and discharge port corresponding to a cylinder of the cylinder block. The valve plate is mounted to the cylinder block intermediate a cylinder head and the cylinder block. The cylinder head has an inner partition wall and an outer partition wall which define a suction chamber and a discharge chamber. The inner partition wall is made slightly longer than the outer partition wall to insure the integrity of the seal created between the inner partition wall and, the valve plate and, therefore, to improve the operating efficiency of the compressor.

BRIEF DESCRIPTION OF THE DRAWINGS

Further objects, features and advantages of this invention will be understood from a reading of the following detailed description taken in conjunction with the drawings wherein.

DETAILED DESCRIPTION

Figure 1:
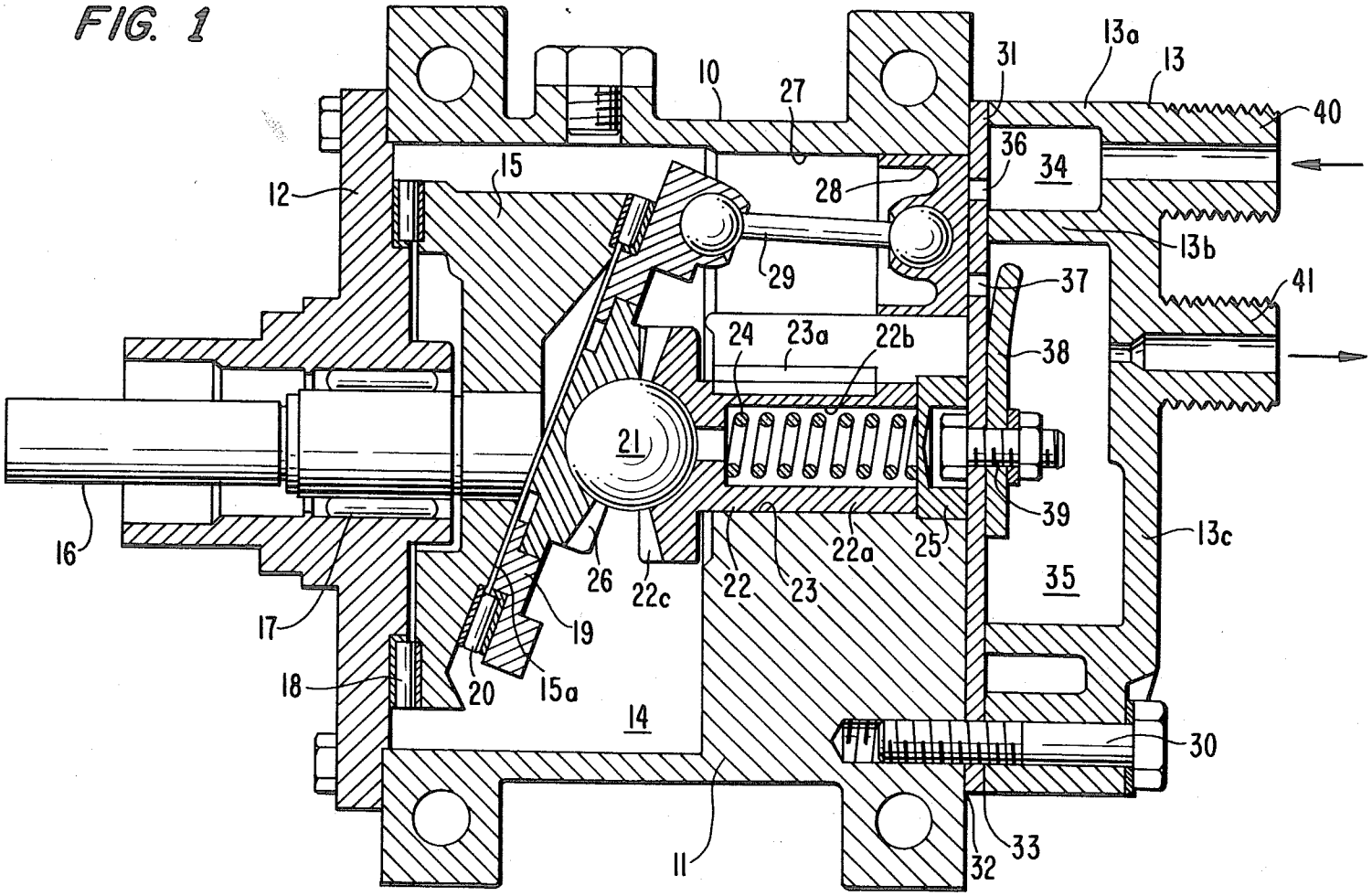
FIG. 1 is a cross-sectional view of a piston type refrigerant compressor in accordance with the present invention.
Figure 2:
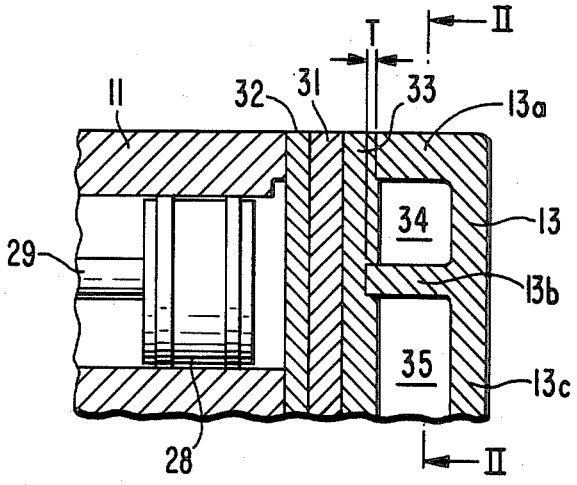
FIG. 2 is a partial cross-sectional view of a piston type refrigerant compressor in accordance with the present invention.
Figure 3:
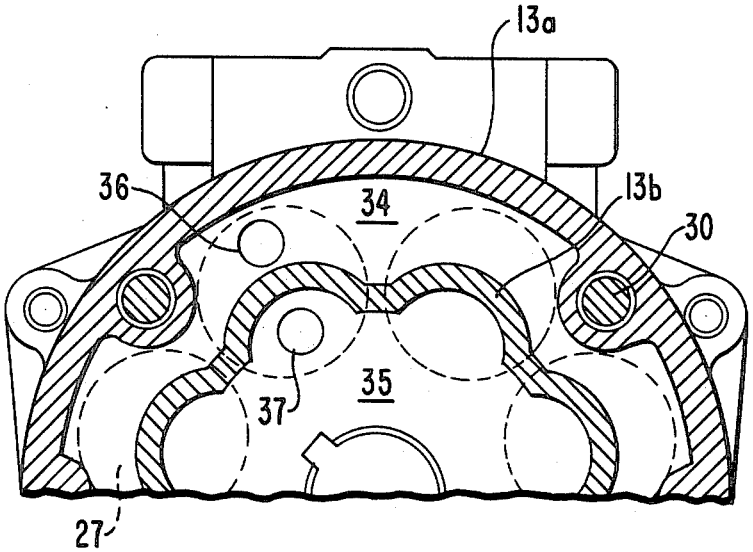
FIG. 3 is a partial cross-sectional view taken along line II—II in FIG. 2.

Referring to FIGS. 1, 2 and 3, a piston type refrigerant compressor in accordance with the present invention is shown. The compressor includes a cylindrical housing 10 comprising cylinder block 11, front housing 12 and cylinder head 13. Crank chamber 14 is defined within the interior of housing 10 between cylinder block 11 and front housing 12. Rotor 15 is disposed within crank chamber 14 and is fixedly mounted to an inner end of drive shaft 16. Drive shaft 16 extends through a central portion of front housing 12 and is rotatably supported in front housing 12 with a bearing such as needle bearing 17. Rotor 15 is also supported on the inner surface of front housing 12 with thrust needle bearing 18. Wobble plate 19 is disposed on the inclined surface 15*a* of rotor 15 supported by needle bearing 20. Wobble plate 19 is non-rotatably supported on steel ball 21 seated at an end of supporting member 22.

Supporting member 22 comprises shank portion 22*a* having axial hole 22*b* at one end and bevel gear portion 22*c* at the other end thereof. Supporting member 22 also has a seat for steel ball 21 at the center thereof. Supporting member 22 is axially slidably, but non-rotatably, supported within cylinder block 11 by inserting shank portion 22*a* into axial hole 23 formed in cylinder block 11. The rotation of supporting member 22 is prevented by a key (not shown) and key groove 23*a*. Coil spring 24 is disposed in axial hole 22b of supporting member 22. The outer end of spring 24 is in contact with screw member 25 so that shank portion 22a is urged toward wobble plate 19. Bevel gear portion 22c of supporting member 22 engages bevel gear 26 mounted on wobble plate 19 so that wobble plate 19 is prevented from rotating. Steel ball 21 is seated on a seat formed at the central portion of bevel gear portion 22c and is also seated on a seat formed at the central portion of bevel gear 26 so that wobble plate 19 is nutatably but non-rotatably supported on steel ball 21.

Cylinder block 11 is provided with a plurality of axial cylinders 27, within which pistons 28 are slidably mounted and closely fitted. Each piston 28 is connected to wobble plate 19 via a respective piston rod 29. The connection between wobble plate 19 and one end of piston rod 29, and the connection between pistons 28 and the other end of piston rod 29, are both made by a ball joint mechanism as shown.

Cylinder head 13 is mounted on cylinder block 11 with a plurality of bolts 30 disposed about the perimeter of cylinder head 13. Bolts 30 extend through gasket elements 32 and 33 and valve plate 31, and are secured to cylinder block 11. The interior of cylinder head 13 is divided into two chambers, i.e., suction chamber 34 and discharge chamber 35, by inner partition wall 13b and outer peripheral wall 13a. Both inner partition wall 13b and outer wall 13a have end surface portions which project from the end plate portion 13c of cylinder head 13 and contact gasket element 33. The end surface portion of outer wall 13a is disposed a first plane substantially normal to outer wall 13a and is disposed from a second plane substantially normal to inner partition wall 13b in which the end surface portion of partition wall 13b is disposed. Hence, inner partition wall 13b is slightly longer than outer partition wall 13a (FIG. 2) such that a reliable seal is created between inner partition wall 13b and gasket element 33.

In the preferred embodiment, the above-mentioned second plane is displaced from the above-mentioned first plane, in the direction away from plate portion 13c, approximately 0.02 mm to 0.08 mm, thus providing a length differential between outer wall portion 13a and inner partition wall portion 13b of approximately 0.02 mm to 0.08 mm. Thus, when cylinder 13 is secured to valve plate 31 through gasket 33 by bolts 30, the force pressing inner partition wall 13b against gasket element 33 is substantially equal to the force pressing outer wall 13a to gasket element 33.

A valve plate assembly comprises valve plate 31 formed on a plurality of suction ports 36 connecting suction chamber 34 and respective cylinders 27 (FIG. 3). Valve plate 31 further includes a plurality of discharge ports 37 connecting discharge chamber 35 and respective cylinders 27. A plurality of suction reed valves (not shown) and a discharge reed valves (not shown) are provided for co-operating with suction ports 36 and discharge ports 37, respectively, as is known in the art. Stopper plate 38 is included for suppressing excessive deformation of the discharge reed valve (see FIG. 1). Bolt and nut 39 is provided for securing the suction reed valve, the discharge reed valve and stopper plate 38 to valve plate 31. Cylinder head 13 is secured on the end surface of cylinder block 11 through valve plate assembly and gasket element 30 by bolts 33. As is known in the art, the valve plate assembly is provided for allowing fluid to enter cylinders 27 from suction ports 36 during evacuation and further for allowing fluid to exit cylinders 27 via discharge ports 37 during compression.

In operation of the compressor, drive shaft 16 is driven by any suitable rotating drive source, such as an automobile engine. Rotor 15 rotates with drive shaft 16 such that wobble plate 19 may nutate about steel ball 21 in response to the rotation of inclined surface 15a of rotor 15. The nutation of wobble plate 19 causes the reciprocation of respective pistons 28. Therefore, the evacuation and compression of the refrigerant gas is repeatedly performed in each cylinder. The refrigerant gas circulates through a cooling circuit which is connected between inlet port 40 and outlet port 41 at cylinder head 13.

It will be apparent to those skilled in the art that the subject invention provides a simple and inexpensive yet effective way for improving the seal of a compressor to prevent refrigerant from leaking into the suction chamber from the discharge chamber. Hence, the subject invention provides an inexpensive way to further improve the operating efficiency of a piston type compressor.

Although this invention has been described in detail by reference to a preferred embodiment, many modifications and variations will readily become apparent to those skilled in the art. It should be realized that the present invention is not limited to the particular embodiment disclosed, but its scope is intended to be governed only by the scope of the appended claims.

We claim:

1. A cylinder head for fluid compressor, said cylinder head comprising an end plate portion with an outer wall portion and an inner partition wall portion extending from said end plate portion and defining a suction chamber and a discharge chamber, said wall portions including end surfaces disposed in parallel planes spaced from and opposed to said end plate portion with the plane of the end surface of said inner partition wall portion being disposed from said end plate portion approximately 0.02 mm to 0.08 mm greater than the plane of the end surface of said outer wall portion, means disposed about the perimeter of said cylinder head for fasteniing the same to a cylinder block through a valve plate adapted to close said suction chamber and said discharge chamber and having ports opening into the same and gasket means interposed between said end surfaces and said valve plate, whereby said end surfaces are in sealing engagement with said gasket.

2. In a piston-type refrigerant compressor including a cylinder block having a plurality of spaced cylinders formed therein, a plurality of pistons slidably and closely fitted into respective ones of said cylinders, a front end plate mounted to said cylinder block, means for reciprocating said pistons within said cylinders, a cylinder head provided with an inner partition wall and an outer partition wall to divide the interior of said cylinder head into two chambers, said cylinder head being mounted to one end of said cylinder block and in contact with a first gasket between said cylinder head and a valve plate means, said valve plate means being in contact with a second gasket between said valve plate means and said cylinder block, said first and second gaskets being provided such that said cylinder head and said valve plate means are sealably mounted to said cylinder block, said valve plate means being provided for allowing fluid to enter said cylinders from said suction chamber and to be discharged from said cylinders into said discharge chamber, the improvement comprising said inner partition wall being slightly longer than said outer wall.

3. A piston type refrigerant compressor as recited in claim 2 wherein the length differential between said inner partition wall and said outer partition wall is within the range of 0.02 mm to 0.08 mm.

4. A compressor comprising:

a cylinder block having a plurality of cylinders formed therein;

a plurality of pistons, each piston being disposed within one of said cylinders;

means for reciprocating said pistons to provide evacuation and compression within said cylinders;

valve plate means including a plurality of suction ports and discharge ports each suction port and discharge port being associated with one said cylinder, said valve plate means being adapted to allow fluid to flow into said cylinders upon evacuation via said suction ports and further to allow fluid to flow from said cylinders upon compression via said discharge ports; and a cylinder head mounted to said cylinder block, said cylinder head having an outer wall portion and an inner partition wall portion in contact with said valve plate means such that a suction chamber and a discharge chamber are formed within said cylinder head, said cylinder head including means for receiving a fluid into said suction chamber and means for discharging a fluid out of said discharge chamber, said inner partition wall portion being slightly longer than said outer wall portion.

5. Apparatus as recited in claim 4 wherein the difference in length between said outer wall portion and said inner partition wall portion is within the range of 0.02 mm to 0.08 mm.

6. Apparatus as recited in claim 4 wherein said valve plate means includes a seal disposed between said valve plate means and said cylinder head such that said cylinder head is sealably mounted to said valve plate means.

* * * * *